US006575172B1

(12) United States Patent
Crosby

(10) Patent No.: US 6,575,172 B1
(45) Date of Patent: Jun. 10, 2003

(54) DISPOSABLE NAIL POLISH REMOVAL PAD WITH HANDLE

(76) Inventor: Marion Crosby, 9027 Greenview St., Detroit, MI (US) 48228

( * ) Notice: Subject to any disclaimer, the term of this patent is extended or adjusted under 35 U.S.C. 154(b) by 0 days.

(21) Appl. No.: 09/963,919

(22) Filed: Sep. 26, 2001

Related U.S. Application Data

(60) Provisional application No. 60/235,288, filed on Sep. 26, 2000.

(51) Int. Cl.[7] ..... A45D 29/00

(52) U.S. Cl. ..... 132/74.5; 132/320; 15/104.94; 15/210.1; 604/1

(58) Field of Search ..... 132/73, 73.5, 74.5, 132/75.6, 76.4, 76.5, 317, 320; 15/209.1, 210.1, 220.4, 229.14, 229.11, 229.13, 244.1, 104.94, 244.2; 206/205, 209, 210, 229, 361, 438, 570, 581, 823; 604/1, 2, 3

(56) References Cited

U.S. PATENT DOCUMENTS

| | | | | | |
|---|---|---|---|---|---|
| 893,004 | A | * | 7/1908 | Miller | 132/76.4 |
| 900,758 | A | * | 10/1908 | Miller | 132/76.4 |
| 4,014,616 | A | * | 3/1977 | Mast, Jr. et al. | 401/292 |
| 4,053,242 | A | * | 10/1977 | Mast, Jr. | 401/6 |
| 4,474,195 | A | | 10/1984 | Warner | |
| 4,643,725 | A | * | 2/1987 | Schlesser et al. | 604/306 |
| 4,671,306 | A | | 6/1987 | Spector | |
| 4,701,168 | A | * | 10/1987 | Gammons | 604/310 |
| 4,854,761 | A | | 8/1989 | Smith et al. | |
| 4,884,913 | A | | 12/1989 | Smith et al. | |
| 4,893,956 | A | * | 1/1990 | Wojcik et al. | 401/130 |
| D306,083 | S | | 2/1990 | Smith et al. | |
| 4,938,347 | A | | 7/1990 | Tillman | |
| 5,024,325 | A | * | 6/1991 | Gundlach | 206/229 |
| 5,026,541 | A | | 6/1991 | Lanier | |
| 5,230,119 | A | * | 7/1993 | Woods et al. | 15/209.1 |
| 5,487,932 | A | * | 1/1996 | Dunshee | 428/68 |
| 5,810,021 | A | | 9/1998 | Walker | |
| 6,006,413 | A | * | 12/1999 | Farley | 29/459 |
| 6,035,859 | A | | 3/2000 | Antonopoulos-McIvor | |
| 6,044,515 | A | * | 4/2000 | Zygmont | 15/209.1 |
| 6,446,795 | B1 | * | 9/2002 | Allen et al. | 206/210 |

* cited by examiner

*Primary Examiner*—Kevin Shaver
*Assistant Examiner*—David Comstock
(74) *Attorney, Agent, or Firm*—John D. Gugliotta; P. Jeff Martin; Olen L. York, III

(57) ABSTRACT

A disposable nail polish removal pad with handle is provided having an elongated handle bifurcating into a V-shaped base portion. The V-shaped base portion has an absorbent cotton applicator bonded to an upper surface thereof. The disposable nail polish removal pad with handle allows for the removal of nail polish from toenails in a manner which ensures that any nail polish on fingernails is not damaged.

9 Claims, 4 Drawing Sheets

DISPOSABLE NAIL POLISH REMOVAL PAD WITH HANDLE

RELATED APPLICATIONS

The present invention is a conversion of a United States Provisional Patent Application, Ser. No. 60/235,288 filed on Sep. 26, 2000.

BACKGROUND OF THE INVENTION

1. Field of the Invention

The present invention relates generally to devices for removing nail polish and, more particularly, to a disposable nail polish removal pad with handle.

2. Description of the Related Art

One of the most common beauty and makeup aids used by women is that of fingernail polish. While the vast majority of fingernail polish is applied to fingernails, many women who wear open shoes also apply it to their toenails. While the appearance of painted toenails is aesthetically pleasing, it is a difficult ordeal to achieve. While the application of the nail polish is more difficult when applied to the toes in lieu of the fingers, the removal of such is even more so. Additionally, it is almost impossible for a woman to use nail polish remover on her toenails without messing up the polish on her fingernails that was previously applied.

A search of the prior art did not disclose any patents that read directly on the claims of the instant invention; however, the following references were considered related. The following patents disclose a disposable nail polish removing thimble: U.S. Pat. No. 5,810,021 issued in the name of Walker; and U.S. Pat. No. 4,671,306 issued in the name of Spector.

The following patents describe a disposable single digit nail polish remover pouch: U.S. Pat. No. 4,938,347 issued in the name of Tillman; and U.S. Pat. No. 4,474,195 issued in the name of Warner.

U.S. Pat. No. 6,035,859 issued in the name of Antonopoulos-McIvor discloses a tool for removing fingernail polish.

The following patents describe the design and function of a nail polish remover wand containing disposable pads: U.S. Pat. No. 4,884,913 issued in the name of Smith et al.; U.S. Pat. No. 4,854,761 issued in the name of Smith et al.; and U.S. Pat. No. D 306,083 issued in the name of Smith et al.

U.S. Pat. No. 5,026,541 issued in the name of Lanier discloses a disposable fingernail polish removing device.

Consequently, a need has been felt for providing a device which allows for nail polish to be quickly and easily removed from toenails without affecting fingernail polish.

SUMMARY OF THE INVENTION

Therefore, it is an object of the present invention to provide a nail polish removal pad which is designed to remove nail polish from toenails.

It is another object of the present invention to provide a nail polish removal pad which protects nail polish on fingernails from damage.

It is another object of the present invention to provide a nail polish removal pad which is disposable.

It is another object of the present invention to provide a nail polish removal pad which is available in quantity packaging.

It is another object of the present invention to provide a nail polish removal pad with an absorbent cotton applicator.

It is another object of the present invention to provide a nail polish removal pad having a handle made of cardboard which is easy to hold.

It is still another object of the present invention to provide a nail polish removal pad having a handle with a long design which keeps fingernails away from nail polish remover.

Briefly described according to one embodiment of the present invention, a disposable nail polish removal pad with handle is provided having a disc-shaped, cardboard base portion with an absorbent cotton applicator bonded to an upper surface thereof. An elongated cardboard handle is perpendicularly adhered with a suitable adhesive to an opposite surface of the base portion.

The use of the present invention allows for the removal of nail polish from toenails in a manner which is quick, easy, and effective while ensuring that any nail polish on fingernails is not damaged.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
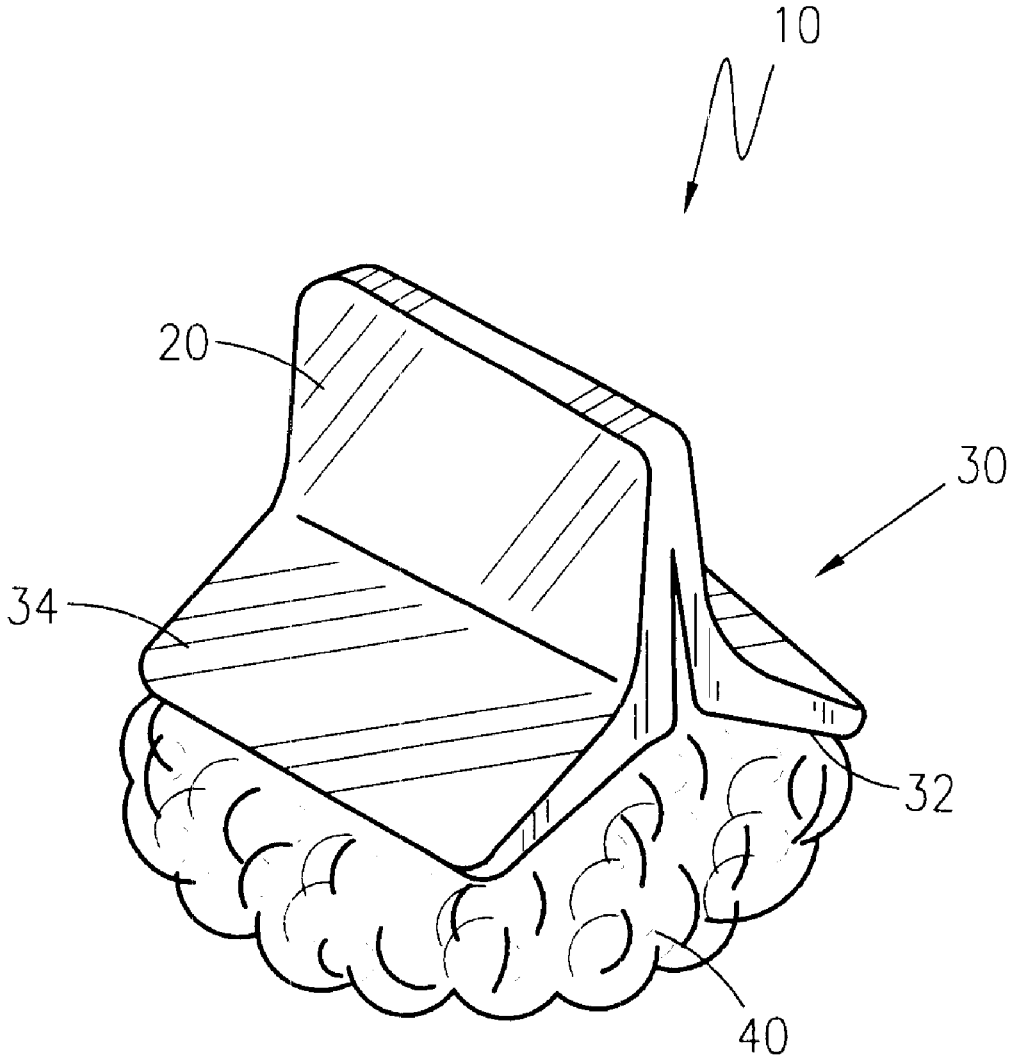
FIG. 1 is a perspective view of a disposable nail polish removal pad with handle according to the preferred embodiment of the present invention.
Figure 2:
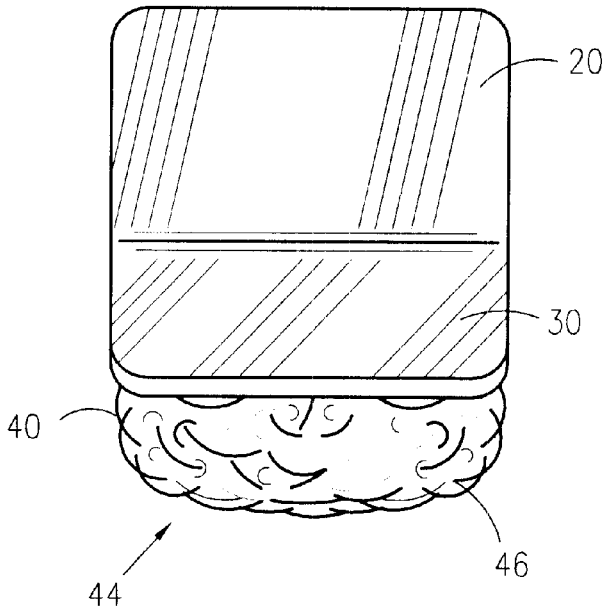
FIG. 2 is a side elevational view thereof.
Figure 3:
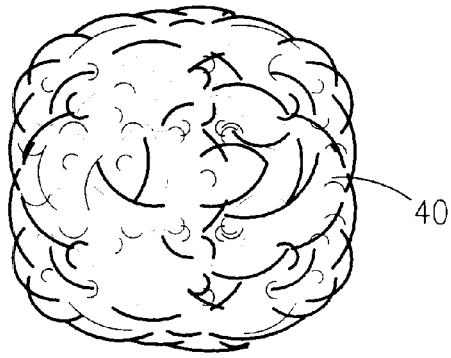
FIG. 3 is a top plan view thereof.
Figure 4:
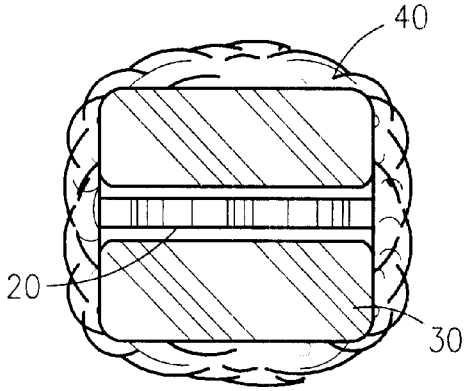
FIG. 4 is a bottom plan view thereof.

Referring now to FIGS. 1–4, a disposable nail polish removal pad with handle 10 is shown, according to the present invention, comprised of an elongated handle 20 which bifurcates into a V-shaped base portion 30. The handle 20 provides a grasping means for facilitating easy manipulation thereof between fingers of a user. V-shaped base portion 30 is defined as having an upper surface 32 opposite a lower surface 34. The handle 20 and the V-shaped base portion 30 are fabricated of cardboard material in a stamping process; however, it is envisioned that wood or other similar material being resistant to nail polish remover may be utilized. The length of the handle 20 in combination with the V-shaped base portion 30 serve to provide a shield against any damage to nail polish on fingernails during use of the present invention.

An absorbent cotton applicator 40 is bonded to the upper surface 32 of the V-shaped base portion 30 by any suitable bonding means known in the art, wherein such means includes but is not limited to gluing, cementing, bonding, or the like. Such bonding means results in a seal between the cotton applicator 40 and the upper surface 32 of the V-shaped base portion 30 which is inert to a chosen solvent 44 being suitable for dissolving nail polish. For purposes of this disclosure, acetone 46 is envisioned as the solvent 44 typically utilized as a nail polish remover.

The cotton applicator 40 is of a circular, dome-like configuration, dimensionally sized so as to facilitate removal of nail polish from toenails while ensuring any nail polish on fingernails is not damaged.

Figure 5:
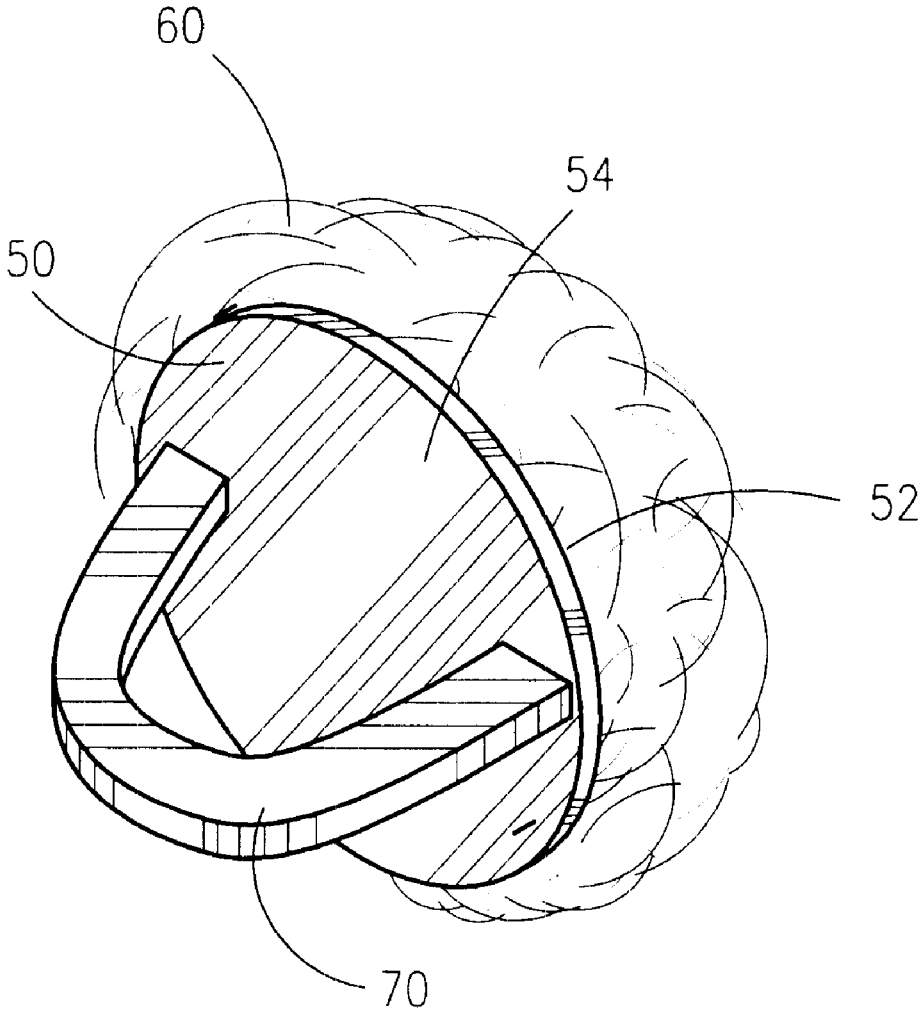
FIG. 5 is a perspective view of an alternate embodiment of the present invention.
Figure 6:
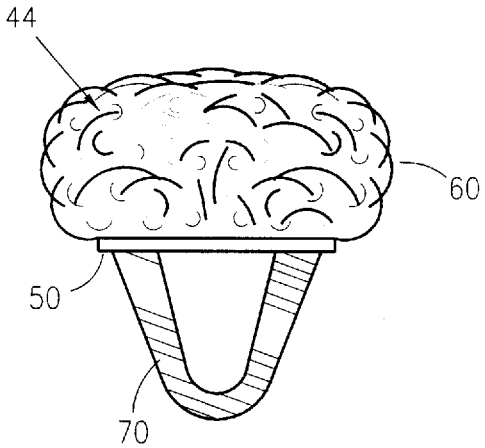
FIG. 6 is a side elevational view of the alternate embodiment of the present invention.
Figure 7:
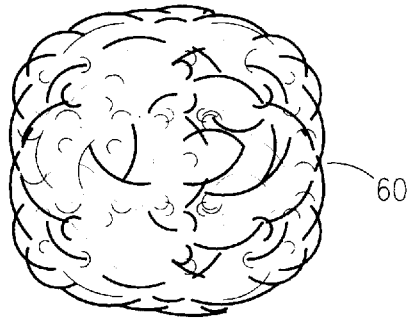
FIG. 7 is a top plan view of the alternate embodiment of the present invention.
Figure 8:
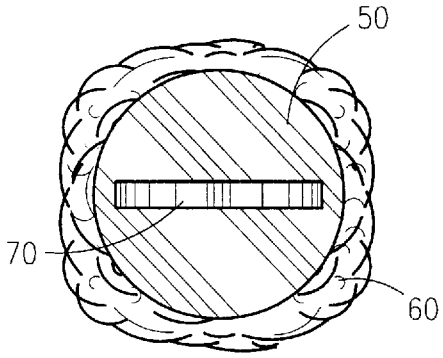
FIG. 8 is a bottom plan view of the alternate embodiment of the present invention.

Referring now to FIGS. 5–8, an alternate embodiment of the present invention is shown, and is comprised of a disc-shaped base portion 50 having an upper surface 52 opposite a lower surface 54. The base portion 50 is fabricated of cardboard material in a stamping process; however, it is envisioned that wood or other similar material being resistant to nail polish remover may be utilized.

An absorbent cotton applicator 60 is bonded to the upper surface 52 of the base portion 50 by any suitable bonding means known in the art, wherein such means includes but is not limited to gluing, cementing, bonding, or the like. Such bonding means results in a seal between the cotton applicator 60 and the upper surface 52 of the base portion 50 which is inert to a chosen solvent 44 being suitable for dissolving nail polish. The cotton applicator 60 is of a circular, dome-like configuration, dimensionally sized so as to facilitate removal of nail polish from toenails while ensuring any nail polish on fingernails is not damaged.

Perpendicularly adhered with a suitable adhesive to the lower surface 24 of the base portion 50 projects a finger-held, linearly elongated, C-shaped handle portion 70 providing a grasping means for facilitating easy manipulation thereof between fingers of a user. The handle portion 70 is fabricated of cardboard material in a stamping process, and like the base portion 50, may be fabricated of wood or similar material resistant to nail polish remover. The length of the handle portion 70 in combination with the base portion 50 serve to provide a shield against any damage to nail polish on fingernails during use of the present invention.

The present invention is designed and configured for use by both professional nail technicians and by individuals for removing nail polish from toenails while preserving the nail polish on one's fingernails.

It is envisioned that the present invention is available in packages of 25 or more units.

Being fabricated of cardboard and cotton material, the present invention is environmentally safe for disposal after use.

It should be noted that the present invention is readily applicable not only to toenails, but fingernails as well, upon a user's desire.

2. Operation of the Preferred Embodiment

To use the present invention, the user simply grasps the handle 20 between one's fingers, dips the cotton applicator 40 in a suitable solvent 44 and rubs the subsequently permeated cotton applicator 40 on a painted toenail so as to effectively remove the nail polish therefrom. Once the toenails have been dissolved of all nail polish, the user disposes of the present invention.

The use of the present invention allows for the removal of nail polish from toenails in a manner which is quick, easy, and effective while ensuring that any nail polish on fingernails is not damaged.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A disposable nail polish removal pad comprising:

an elongated handle, said elongated handle bifurcating into a V-shaped base portion, said V-shaped base portion is defined as having an upper surface opposite a lower surface, said elongated handle providing a grasping means for facilitating easy manipulation of said disposable nail polish removal pad between fingers of a user; wherein said elongated handle is fabricated of a material resistant to nail polish remover; and an absorbent cotton applicator, said absorbent cotton applicator is of a circular, dome-like configuration and dimensionally sized so as to facilitate removal of nail polish from toenails while ensuring any nail polish on fingernails is not damaged.

2. The disposable nail polish removal pad of claim 1, wherein said V-shaped base portion and said elongated handle are fabricated of cardboard.

3. The disposable nail polish removal pad of claim 1, wherein said absorbent cotton applicator is bonded to said upper surface of said V-shaped base portion by a suitable bonding means, wherein said suitable bonding means includes gluing, cementing, and bonding.

4. The disposable nail polish removal pad of claim 3, wherein said suitable bonding means results in a seal between said absorbent cotton applicator and said upper surface of said V-shaped base portion; wherein said seal is inert to a chosen solvent.

5. A disposable nail polish removal pad comprising:

a disc-shaped base portion, said disc-shaped base portion has an upper surface opposite a lower surface, and wherein said base portion is fabricated of a material resistant to nail polish remover;

an absorbent cotton applicator; said absorbent cotton applicator is of a circular, dome-like configuration and dimensionally sized so as to facilitate removal of nail polish from toenails while ensuring any nail polish on fingernails is not damaged; and a handle portion, said handle portion is of a linearly elongated, C-shaped configuration affixed to said lower surface of said disc-shaped base portion and fabricated of a material resistant to nail polish remover, and wherein said handle portion provides a grasping means for facilitating easy manipulation of said disposable nail polish removal pad between fingers of a user.

6. The disposable nail polish removal pad of claim 5, wherein said absorbent cotton applicator is bonded to said upper surface of said base portion by a suitable bonding means, wherein said suitable bonding means includes gluing, cementing, and bonding.

7. The disposable nail polish removal pad of claim 6, wherein said suitable bonding means results in a seal between said cotton applicator and said upper surface of said base portion, wherein said seal is inert to a chosen solvent.

8. The disposable nail polish removal pad of claim 5, wherein said handle portion is perpendicularly adhered to said lower surface of said base portion.

9. The disposable nail polish removal pad of claim 5, wherein said base portion and said handle portion are fabricated of cardboard.

* * * * *